US006030283A

United States Patent [19]

Anderson

[11] Patent Number: 6,030,283

[45] **Date of Patent: *Feb. 29, 2000**

[54] ICE SKATE BLADE SHARPENER

[75] Inventor: Bradley J. Anderson, Alexandria, Minn.

[73] Assignee: Edge Specialties, Inc

[ * ] Notice: Under 35 U.S.C. 154(b), the term of this patent shall be extended for 107 days.

[21] Appl. No.: 08/610,279

[22] Filed: Mar. 4, 1996

[51] Int. Cl.[7] ..... B23F 21/03

[52] U.S. Cl. ..... 451/558; 451/545; 451/541

[58] Field of Search ..... 451/540, 541, 451/545, 552, 555, 557, 558

[56] References Cited

U.S. PATENT DOCUMENTS

| | | |
|---|---|---|
| 927,131 | 7/1909 | Dow . |
| 1,006,000 | 10/1911 | Oosdyke . |
| 1,273,624 | 7/1918 | Krollius . |
| 1,466,785 | 9/1923 | Brunell . |
| 2,032,640 | 3/1936 | Swetta et al. . |
| 2,054,495 | 9/1936 | Corkum . |
| 2,092,831 | 9/1937 | Cannon . |
| 2,118,617 | 5/1938 | Nicolet . |
| 2,398,566 | 4/1946 | Talbert . |
| 2,428,473 | 10/1947 | Slocum . |
| 2,550,765 | 5/1951 | Brown . |
| 2,900,769 | 8/1959 | Toms . |
| 3,157,973 | 11/1964 | Chattillion . |
| 3,596,411 | 8/1971 | Hutchins . |
| 3,841,030 | 10/1974 | Laszlo . |
| 4,219,975 | 9/1980 | Scholler . |
| 4,815,240 | 3/1989 | Larson . |
| 4,908,994 | 3/1990 | Fraser . |
| 4,910,923 | 3/1990 | McCabe . |
| 5,189,845 | 3/1993 | Courchesne . |
| 5,195,277 | 3/1993 | Courchesne . |
| 5,197,232 | 3/1993 | Ellestad . |
| 5,381,629 | 1/1995 | Salvail . |
| 5,383,307 | 1/1995 | Anderson . |
| 5,431,597 | 7/1995 | Anderson . |
| 5,445,050 | 8/1995 | Owens . |

*Primary Examiner*—Eileen P. Morgan
*Attorney, Agent, or Firm*—Burd, Bartz & Gutenkauf

[57] ABSTRACT

A hand held ice skate blade sharpening tool has a holder having a rotatably mounted cylindrical sharpening stone material. The holder and stone are retained with a two-piece body. A releasable connector holds the body together. The body has a longitudinal access slot extending radially from the outer surface of the stone. Elongated guides projecting upwardly adjacent the slot are transversely spaced at a distance substantially the same as the width of an ice skate blade to guide and limit lateral movement of the blade within the slot during the sharpening procedure. Shims are positioned in grooves in the guides to adjust the width of the slot to accommodate ice skate blades having different thicknesses. A transverse groove intersects the slot and guides. The bottom of the transverse groove is open to the channel exposing the outer surface of the stone. A thumb or finger is placed in the transverse groove to slightly rotate the stone within the holder to move an unused sharpening surface of the stone into alignment with the slot. The body is separated to replace the holder and stone with another holder having a different sized stone to achieve different degrees of sharp edge profiles.

32 Claims, 13 Drawing Sheets

ICE SKATE BLADE SHARPENER

FIELD OF THE INVENTION

The invention relates to hand tools for resurfacing and sharpening blades, and more particularly, ice skate blades. The tools have cylindrical stones of abrasive material used to sharpen opposite edges of the blades and maintain the longitudinal concave grooves along the bottom of the blades.

BACKGROUND OF THE INVENTION

Commonly, the blades of ice skates are sharpened or touched up using a rotating grinding wheel of a grinding machine. The grinding machine takes a sizeable cut out of the blade each time it is used to sharpen the blade which reduces the life of the blade. Also, the cost of using the grinding machine limits the number of times a skater can affordably sharpen his or her skates. Bringing skates to the grind shop is time consuming and often impractical to repair game or performance time blade damage.

Hand held devices having stones of abrasive material are used to sharpen and touch up the bottom edges of ice skate blades as an alternative to the grinding machine. Each stone has a uniform diameter which provides a longitudinal concave groove along the bottom of the blade. It is desirable to have a device wherein the blade can be shaped to a desired concave along the bottom the ice skate blade. This requires a separate tool having a stone of a different diameter. A number of different tools are used to provide this feature. An example of an ice skate blade edge resurfacer is shown by B. J. Anderson in U.S. Pat. No. 5,431,597. This tool has a one-piece body accommodating a cylindrical stone rotatably confined within a cylindrical passage in the body. The stone can be rotated to change the position of the surface in alignment with a slot that accommodates the ice skate blade. The device is moved longitudinally in opposite directions along the blade to sharpen the lower edge of the blade and provide a longitudinal concave groove in the blade.

SUMMARY OF THE INVENTION

The invention is directed to versatile hand operated ice skate sharpening tools that function to prolong skate blade life and lower costs and inconvenience associated with conventional skate grinding. The tool has a two-piece body having engaging transverse ends and longitudinally aligned bores. An abrasive member or stone located within the bores can be rotated about its longitudinal axis to change the position of the surface of the abrasive member relative to a slot accommodating the blade of an ice skate. A connector holds the two-piece body together. The connector can be released from holding the two-piece body together whereby the body assembly can be separated so that the abrasive member can be removed and cleaned or replaced with another abrasive member.

The tool in one form of the invention has a cylindrical abrasive member or stone rotatably accommodated by a holder located within a two-piece body assembly whereby unused surfaces of the stone can be rotated and used to sharpen ice skate blades. The stone is easily removed from the two-piece body assembly by separating the body assembly so that a replacement holder and stone can be used whereby different degrees of sharp edge profiles can be achieved.

The sharpener has a generally rectangular body assembly having a first body section coupled to a second body section.

Each body section may be molded rigid plastic, metal or a composite metal. The inner end of each body section has pins that are located in corresponding holes in the opposite body section with a tight fit to couple and align the body sections together. The body sections each have a cylindrical bore open to the inner end that define a cylindrical chamber extending longitudinally of the body. A cylindrical abrasive member is located in the chamber. A cylindrical abrasive member is a honing stone rotatably located in a longitudinal groove in the holder that is used for sharpening edges of an ice skate blade. The holder has inwardly directed lips adjacent the groove to retain the stone within the groove. The diameter of the stone is slightly less than the diameter of the longitudinal groove so that the stone can be rotated to position unused surfaces of the stone adjacent the edges of the skate blade. The stone has a convex curved outer surface that is complementary to the concave curve on the bottom surface of the blade. The outer ends of the holder and stone are located adjacent end members of the body sections to fix the longitudinal position of the holder and stone relative to the body. In one form of the invention, pins extend from the ends of the of holder into opening in the body sections with a friction fit. The openings also function as relief outlets for honing oil and metal debris. The holder and stone can be removed from the chamber for cleaning purposes or for replacement with another holder having different diameter stone to achieve a different degree of sharp edge profile. The connector is released and the first and second body sections are pulled apart to provide access to the holder and stone. The holder and stone can be removed from the body sections and replaced with another holder and stone or a stone having a diameter slightly less than the diameter of the bores in the body sections.

In another form of the invention, the body sections have inside V-shaped side walls that accommodate a V-shaped holder to prevent the holder from rotating relative to the body. The V-shaped holder has a semi-cylindrical groove for the cylindrical stone.

The top of the body has an elongated slot that extends generally parallel to the longitudinal axis of the body chamber. The slot is open to the top of the chamber and also to the opposite ends of the body. This provides access to a longitudinal section of the outer surface of the stone so that the blade can be sharpened. The blade is prepped with honing oil and inserted into the slot so as to position the bottom surface of the blade in engagement with the outer surface of the stone. Upwardly projecting flanges joined to the body sections adjacent the slot have transversely spaced inner surfaces aligned with the outer sides of the slot to guide the body along the blade and maintain the blade in the plane of a diameter of the stone. The sharpener is then moved lengthwise along the blade in both longitudinal directions to sharpen the edges of the blade. The slot has a width substantially the same as the width of the blade to prevent lateral movement of the blade within the slot. In one form of the invention, the flanges have grooves accommodating shims for adjusting the width of the slot to fit different blade thicknesses. The flanges guide the blade as the sharpener is moved relative to the blade.

A traverse groove in the top of the sharpener body has a bottom portion that intersects the top portion of the chamber. This exposes the stone to facilitate the rotation thereof within the longitudinal groove in the holder. The user positions his thumb or finger in the transverse groove and slightly rotates the stone to position an unused surface of the stone in alignment with the blade slot. When a different diameter stone is needed or when all of the outer surface of the stone becomes worn, the holder and stone can be replaced by uncoupling the first and second body sections and removing the holder and stone from the chamber.

DESCRIPTION OF THE PREFERRED EMBODIMENTS

Figure 1:
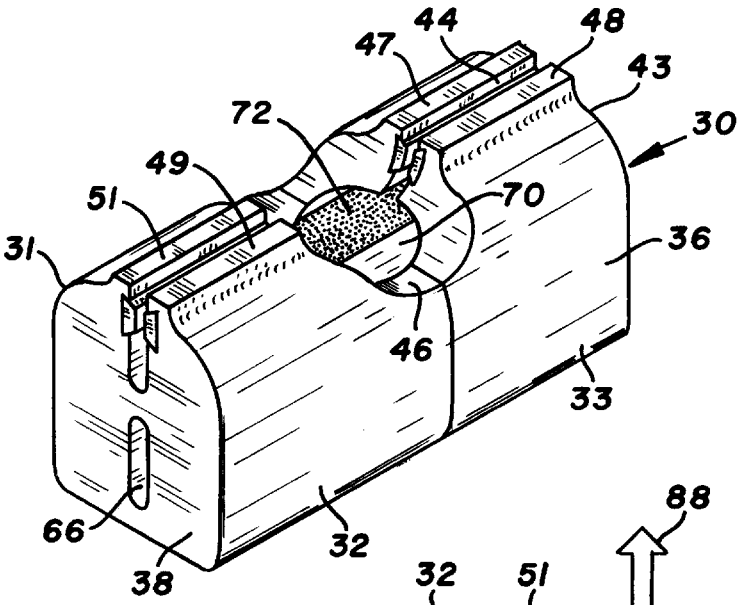
FIG. 1 is a perspective view of an ice skate blade sharpener of the invention.
Figure 2:
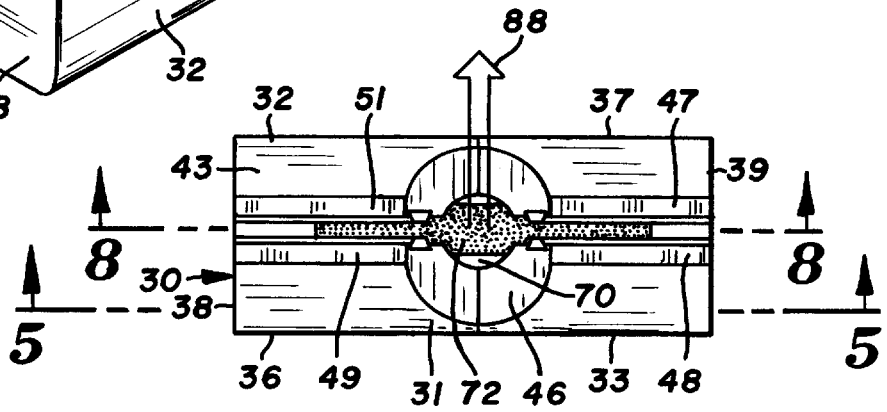
FIG. 2 is a top view of FIG. 1.
Figure 3:
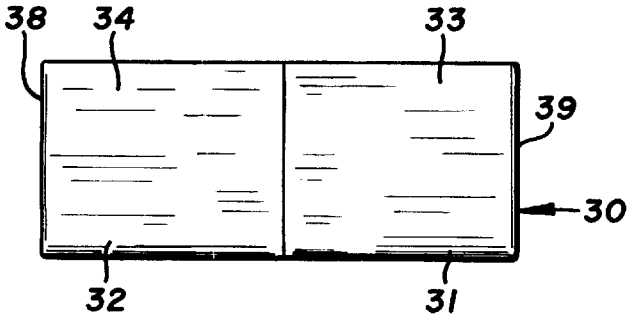
FIG. 3 is a bottom view of FIG. 1.

Referring to FIGS. 1, 2 and 3, there is shown an ice skate blade sharpener, indicated generally at 30. Blade sharpener 30 is used to maintain a concave longitudinal groove 82 and define bottom edges 83 and 84 of an ice skate blade 81. Sharpener 30 is a hand held device that can be carried in an equipment bag and used rink-side to maintain a constant blade sharpness. Sharpener 30 can be used to sharpen other types of blades and knives.

Figure 5:
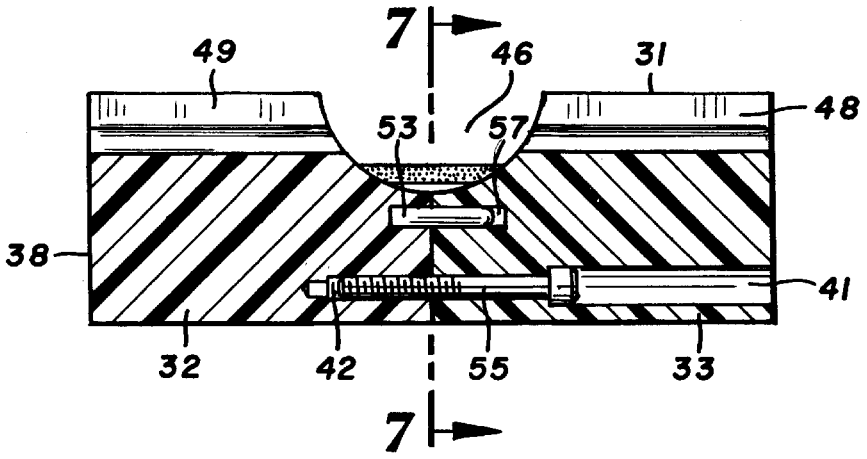
FIG. 5 is an enlarged sectional view taken along the line 5—5 of FIG. 2.
Figure 6:
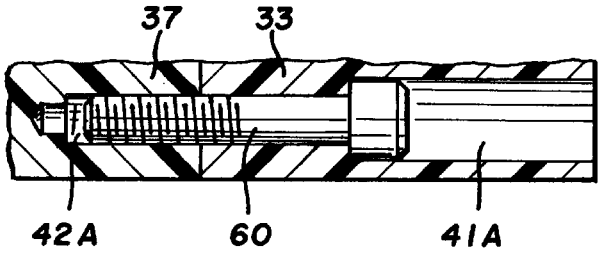
FIG. 6 is a sectional view similar to FIG. 5 showing the second bolt connecting the body sections together.
Figure 7:
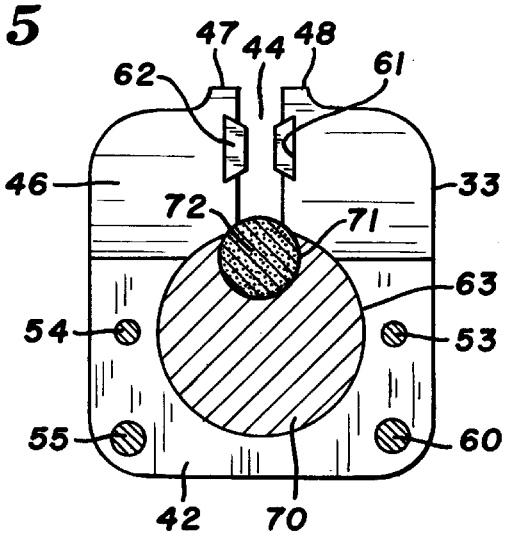
FIG. 7 is an enlarged sectional view taken along the line 7—7 of FIG. 2.

Sharpener 30 has a generally rectangular body or housing assembly 31 having a first body section 32 coupled to a second body section 33. Sections 32 and 33 can be metal, plastic or composite, aluminum and ceramic members, such as the metal matrix composite disclosed in U.S. Pat. No. 5,395,701. Body 31 has a flat bottom surface 34 that curves upwardly into a pair of upright side walls 36 and 37. Upper portions of side walls 36 and 37 curve inwardly to define a top wall 43 of body 31. Each body section 32, 33 has a generally flat outer end 38, 39 that extends between side walls 36 and 37. The inner ends 41 and 42 of body sections 32 and 33 have flat end surfaces located in engagement with each other when body sections 32 and 33 are coupled together. As seen in FIGS. 5, 6 and 7, end 41 has pins 53 and 54 that extend into corresponding holes 57 in end 42 of body section 33. Pins 53 and 54 are located in opposite sides of body assembly 31 to releasably couple first and second body sections 32 and 33 together. Bolts or connectors 55 and 60, located in aligned holes 41 and 42 in body sections 32 and 33, hold the body sections 32 and 33 together. When bolts 55 and 60 are released, body sections 32 and 33 can be pulled apart. Bolts 55 and 60, and pins 53 and 54 transversely and longitudinally align body sections relative to each other. A single bolt can be used to hold body sections 32 and 33 together.

Figure 4:
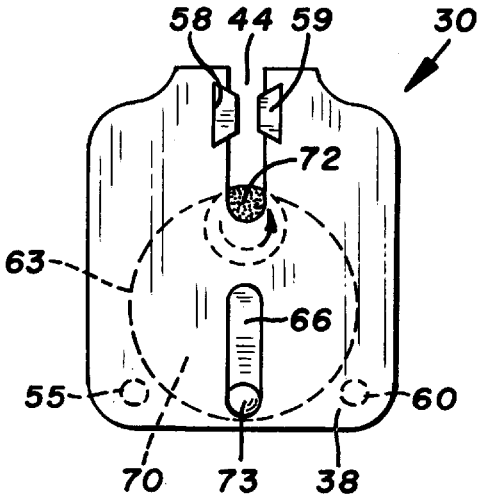
FIG. 4 is an enlarged end view of FIG. 1.

Returning to FIGS. 1 and 2, a slot 44 extends longitudinally on top wall 43 along the length of body 31. Longitudinal slot 44 is open to each end 38 and 39 of body sections 32 and 33. Slot 44 has a width that is substantially the same as the width of a conventional ice skate blade. Upwardly projecting flanges 47, 48, 49 and 51 are joined to top wall 43 adjacent transverse groove 46. Flanges 47–49 and 51 have transversely spaced inner surfaces that form the upper portion of slot 44. Flanges 47–49 and 51 function to guide and prevent lateral movement of the blade during the sharpening procedure as hereinafter described. Shims 58, 59 and 62, projecting into slot 44, are used to adjust the width of slot 44 whereby slot 44 can accommodate ice skate blades having different widths. Shims 58, 59, 61 and 62 are located in longitudinal grooves in the inner surfaces forming slot 44, as seen in FIGS. 4 and 7. Shims 58, 59, 61 and 62 can be removed and replaced with different sized shims to accommodate different widths of ice skate blades.

Figure 8:
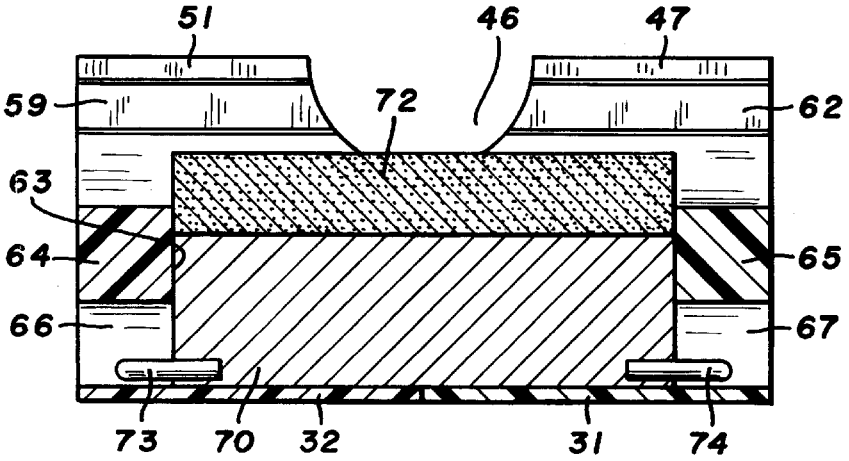
FIG. 8 is an enlarged sectional view taken along the line 8—8 of FIG. 2.
Figure 9:
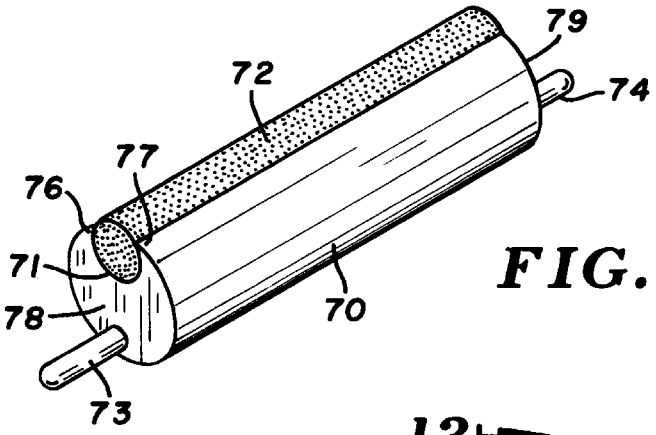
FIG. 9 is a perspective view of the honing stone and holder of the ice skate blade sharpener of FIG. 1.
Figure 10:
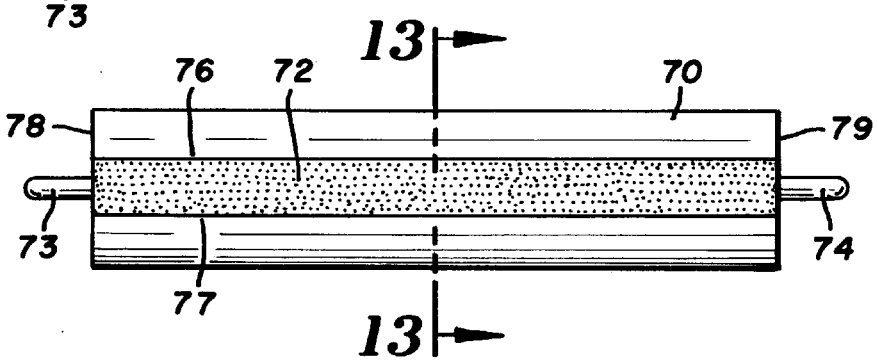
FIG. 10 is an enlarged top plan view of FIG. 9.
Figure 11:
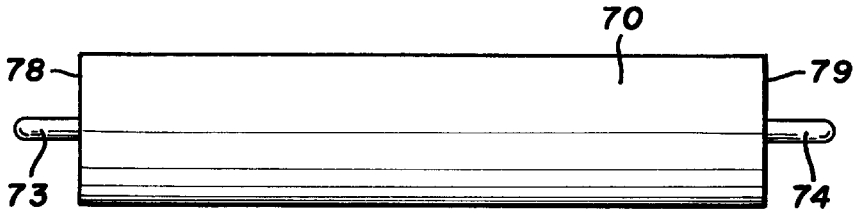
FIG. 11 is a bottom plan view of FIG. 10.
Figure 12:
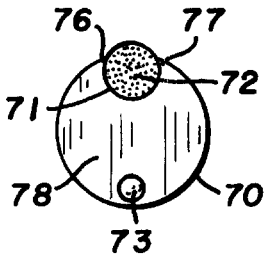
FIG. 12 is an enlarged end view of FIG. 9.
Figure 13:
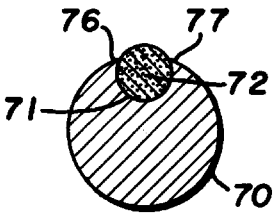
FIG. 13 is a sectional view taken along the line 13—13 of FIG. 10.
Figure 14:
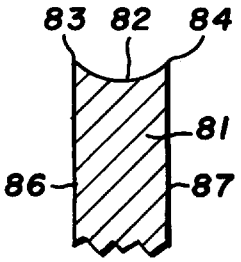
FIG. 14 is a transverse sectional view of an ice skate blade showing the blade edges and concave groove sharpened with the honing stone of FIG. 9.

Referring to FIGS. 1, 2 and 8, each body section 32 has a centrally located cylindrical bore open to inner end wall 41, 42 defining a cylindrical chamber 63. Chamber 63 extends longitudinally in body 31 and body 32 to end walls 64 and 65, as shown in FIG. 8. The top of chamber 63 is open to the bottom of slot 44. The bottom of transverse groove 46 intersects a top portion of chamber 63 at approximately the middle of top wall 43. A person's thumb or finger can be positioned in groove 46 and used to slightly rotate stone 72 to align different surface areas of stone 72 with slot 44.

Referring to FIGS. 4 and 8, a generally cylindrical holder 70 is located in chamber 63 of housing 31. Holder 70 has a longitudinal groove 71 accommodating a cylindrical skate sharpening material or honing stone 72. Inwardly directed lips 76 and 77, located on the top of holder 70, prevent vertical movement of the stone and hold stone 72 within groove 71. Each body section 32, 33 has an opening 66, 67 located adjacent bottom wall 34 and open to chamber 63. Openings 66 and 67 function as relief outlets for honing oil and metal debris resulting from the sharpening procedure.

Referring to FIGS. 9–13, holder 70 has outwardly directed pins 73 and 74 that project into openings 66 and 67 with a friction fit. Pins 73 and 74 fix the circumferential position of holder 70 relative to body 31. Body sections 32 and 33 have end members 64 and 65 engaging outer ends 78 and 79 of holder 70, and the outer ends of stone 72 to limit the longitudinal movement of holder 70 and stone 72 relative to body 31.

A cylindrical abrasive member or honing stone 72 has a diameter that is slightly less than the diameter of longitudinal groove 71 whereby stone 72 can be rotated in groove 71, as shown by arrow 88 in FIG. 2. Stone 72 has a convex curved outer surface that is complementary to concave curve 82 on the bottom of skate blade 81. Stone 72 is rotated to align an unused sharpening surface with the lower end of slot 44. Holder 70 and stone 72 can be removed from housing 31 for replacement or cleaning purposes by separating body sections 32 and 33. Holder 70 can be replaced with a different holder having a stone of different diameter to maintain different concave curves on the bottoms of other ice skate blades.

Referring to FIGS. 15–19, there is shown a modification of the holder, indicated generally at 170. Holder 170 has substantially the same structure as holder 70. Corresponding parts are identified with the prefix "1". Holder 170 has a generally cylindrical sharpening or honing stone 172 used to make a concave groove 182 and define bottom edges 183 and 183 of ice skate blade 181, shown in FIG. 20. Holder 170 has a longitudinal groove 171 accommodating stone 172. Inwardly directed lips 176 and 177, located on the top of holder 170, prevent vertical movement of the stone and hold stone 172 within groove 171.

Figure 42:
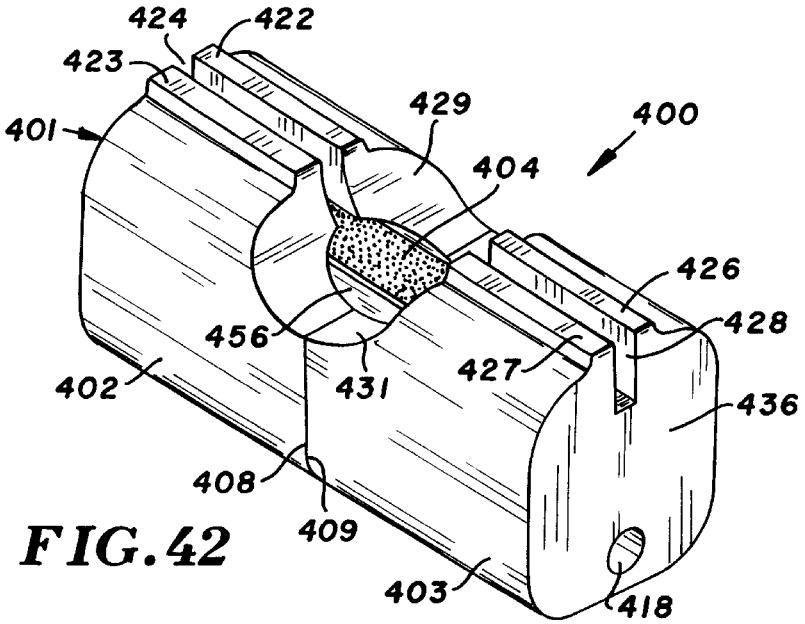
FIG. 42 is a perspective view of a fourth modification of the ice skate blade sharpener of the invention.
Figure 45:
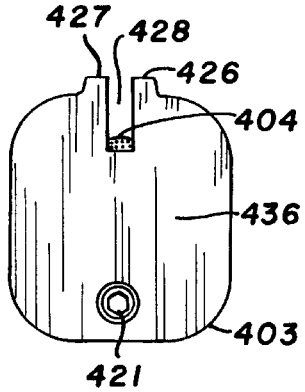
FIG. 45 is an end elevational view of FIG. 42.
Figure 43:
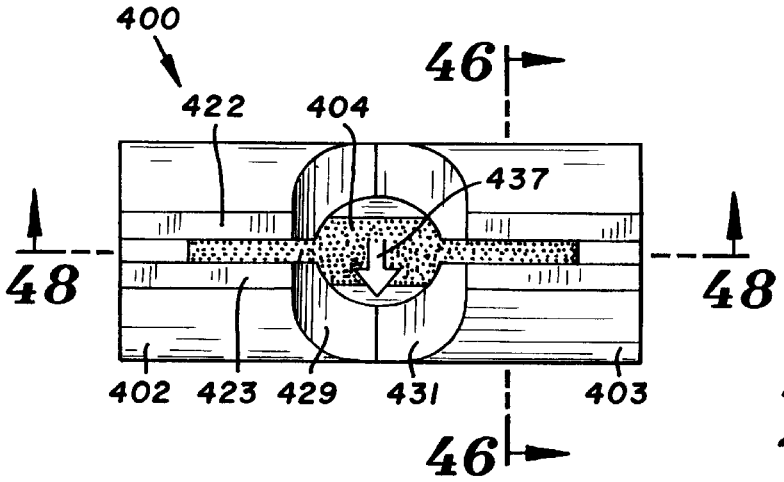
FIG. 43 is a top plan view of FIG. 42.

As shown in FIGS. 15–19, holder 170 has outwardly directed pins 173 and 174 that project into openings 66 and 67 of body sections 32 and 33 with a friction fit. Pins 173 and 184 fix the circumferential position of holder 170 relative to body 31. End members 64 and 65 of body sections 32 and 33 engage outer ends 178 and 179 of cylindrical member 170 and the outer ends of stone 172 to limit the longitudinal movement of cylindrical member 170 and stone 172 relative to body 31. Holders 70 and 170 can have non-circular shapes that engage body sections 32 and 33 to prevent rotation of the body sections relative to the body assembly 31, as shown in FIG. 42.

Figure 15:
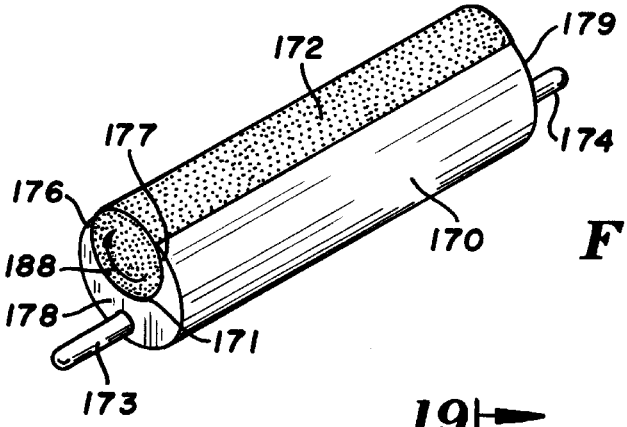
FIG. 15 is a perspective view of a modification of the honing stone and holder.
Figure 16:
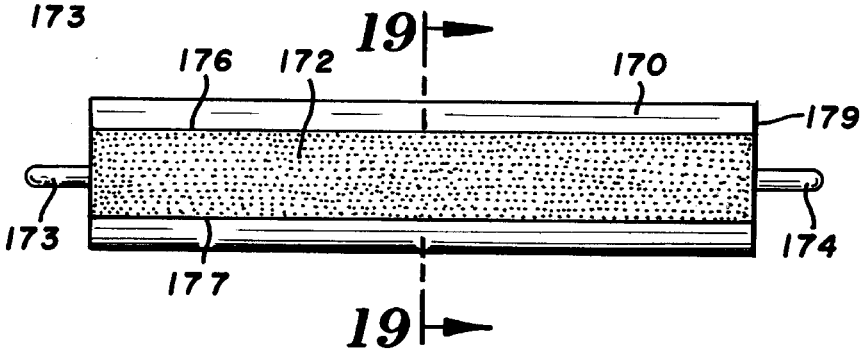
FIG. 16 is an enlarged top plan view of FIG. 15.
Figure 17:
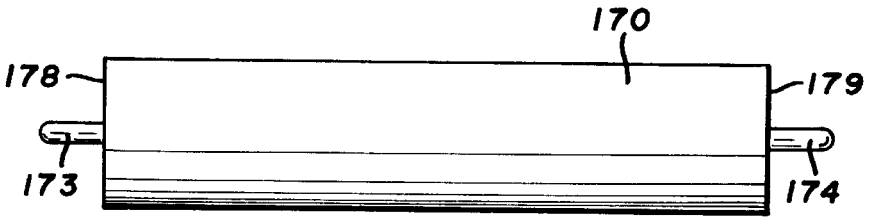
FIG. 17 is a bottom plan view of FIG. 16.
Figure 18:
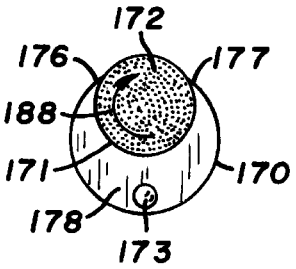
FIG. 18 is an end view of FIG. 16.
Figure 19:
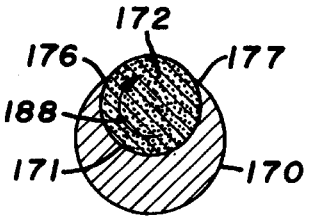
FIG. 19 is a sectional view taken along the line 19—19 of FIG. 16.
Figure 20:
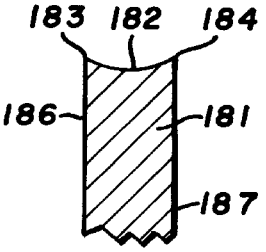
FIG. 20 is a sectional view of an ice skate blade sharpened with the honing stone of FIG. 15.

Honing stone 172 has a diameter that is slightly less than the diameter of longitudinal groove 171 whereby stone 172 can be rotated in groove 171, as shown by arrows 188 in FIGS. 15, 18 and 19. Stone 172 has a convex curve outer surface that is complementary to concave curve 182 on the bottom of skate blade 181. Stone 172 is rotated to align an unused sharpening surface with the lower end of slot 44. Holder 170 and stone 172 can be removed from body 31 for replacement or cleaning purposes by separating body sections 32 and 33. Holder 170 can be replaced with a different holder having a stone of different diameter, such as holder 70 and stone 72, to achieve a different degree of sharp edge profile.

Figure 21:
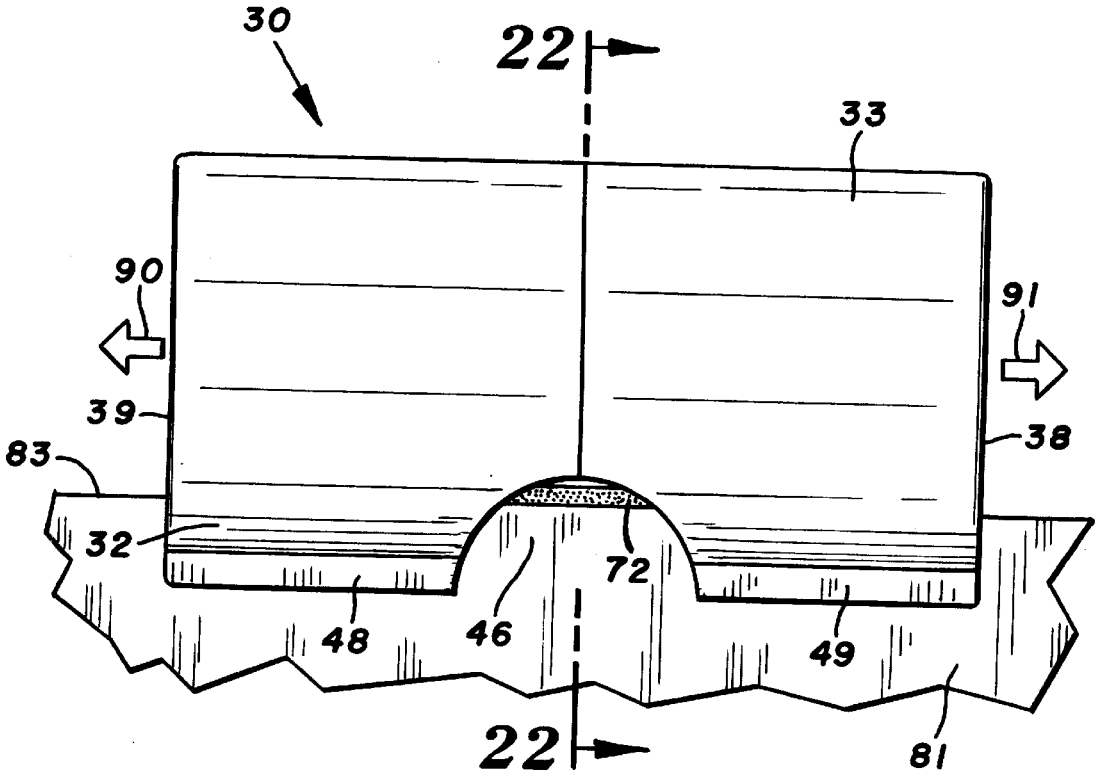
FIG. 21 is an enlarged side view of the skate sharpener of FIG. 1 inserted on a blade of an ice skate blade.
Figure 22:
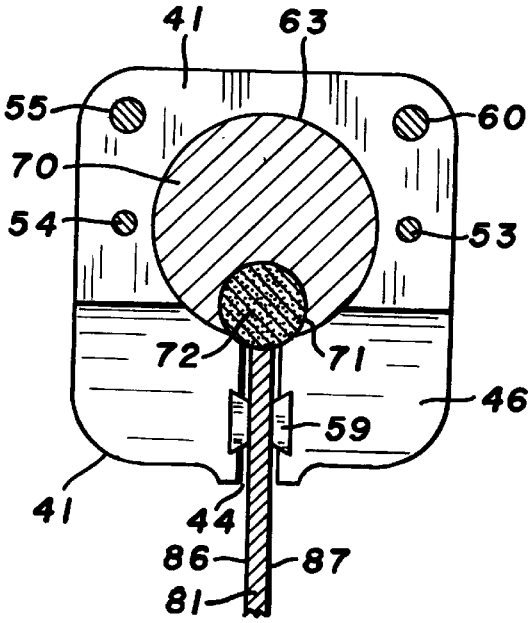
FIG. 22 is a sectional view taken along the line 22—22 of FIG. 21.

In use, blade 81 is positioned on a stable surface with concave groove 82 facing upwardly. Drops of honing oil (not shown) are placed along the length of blade 81 to lubricate the blade. Sharpener 30 is inverted, as shown in FIGS. 21 and 22, and slot 44 is aligned with the longitudinal exterior of blade 81. Side walls 36 and 37 of body 31 are gripped with the thumb and forefingers of one hand of the user. The other hand is placed through the opening in the blade holder of the ice skate to temporarily fix the position of blade 81. Sharpener 30 is installed on blade 81 by moving blade 81 into slot 44 and into engagement with stone 72. Shims 58, 59, 61 and 62 adjust the width of slot 44 to substantially the same as the width of blade 81 whereby sides 86 and 87 of blade 81 are located adjacent the inner surfaces of shims 58, 59, 61 and 62. This prevents lateral movement of blade 81 within slot 44 and prevents skewing of blade edges 83 and 84 during the sharpening process. Shims 58, 59, 61 and 62 can be removed so that blade slot 44 fits different blade thicknesses. The inner surface of shims 58, 59, 61 and 62 slidably engage blade sides 86 and 87 and function to guide blade 81 longitudinally within slot 44 relative to stone 72. The honing oil on blade 81 reduces friction between sides 86 and 87 and the inner surfaces of shims 58, 59, 61 and 62. The operates moves sharpener 30 back and forth lengthwise along blade 81, as indicated by arrows 90 and 91 in FIG. 21, using medium downward pressure. Openings 66 and 67 function as relief outlets for honing oil and metal debris resulting from the sharpening procedure. After every ten to fifteen strokes, sharpener 30 is lifted off of blade 81 to bring stone 72 out of engagement with the blade. The thumb or finger of the operator is placed in transverse groove 46 and used to slightly rotate stone 72, as indicated by arrow 88 in FIG. 2, whereby an unused surface of stone 72 is located directly below the bottom of slot 44. This ensures that stone 72 wears evenly and prolongs the useful life of stone 72. Sharpener 30 is reinstalled on blade 81 by positioning blade 81 in slot 44 and into engagement with stone 72. Blade 81 is stroked enough times to reach edges 83 and 84, and surface 82 has a smooth concave shape. The operator will feel a lip or burr forming on the outer portions of edges 83 and 84 when the edges have been reached.

To finish blade 81, sharpener 30 is removed from blade 81 and a generally flat stone (not shown) is placed on a side 86 of blade 81. The flat stone is moved back and forth approximately six to ten times along the length of side 86 adjacent edge 83 to remove burrs on blade 81. The flat stone is used to finish opposite side 87 of blade 81 in like manner. When both sides 86 and 87 of blade 81 have been worked with the flat stone, excess oil is removed from blade 81 with a cloth or towel.

Cylinder 70 and stone 72 are removable so that different sized or diameter stones can be used, such as stone 172, shown in FIGS. 15–19. Body sections 32 and 33 are pulled apart to replace cylinder 70 on stone 72 with a different cylinder and stone. In this manner, different degrees of sharp edge profiles can be achieved.

Referring to FIGS. 23–26, there is shown a first modification of the ice skate blade sharpener, indicated generally at 100, for resurfacing the bottom edge of an ice skate blade with a concave longitudinal groove in the bottom edge of the blade. Sharpener 100 has a body assembly indicated generally at 101 comprising two face-to-face body members or sections 102 and 103. Members 102 and 103 may be molded of rigid plastic, cast of metal or extruded metal, such as aluminum or composite of aluminum and ceramic, as disclosed in U.S. Pat. No. 5,395.701.

An elongated cylindrical stone 104 of abrasive material is rotatably located in cylindrical bores 106 and 107 in members 102 and 103. Stone 104 is rotatable about its longitudinal axis. Transverse pins 134 and 136, mounted on body sections 102 and 103, engage opposite ends of stone 104 to hold stone 104 within body assembly 101.

Figure 26:
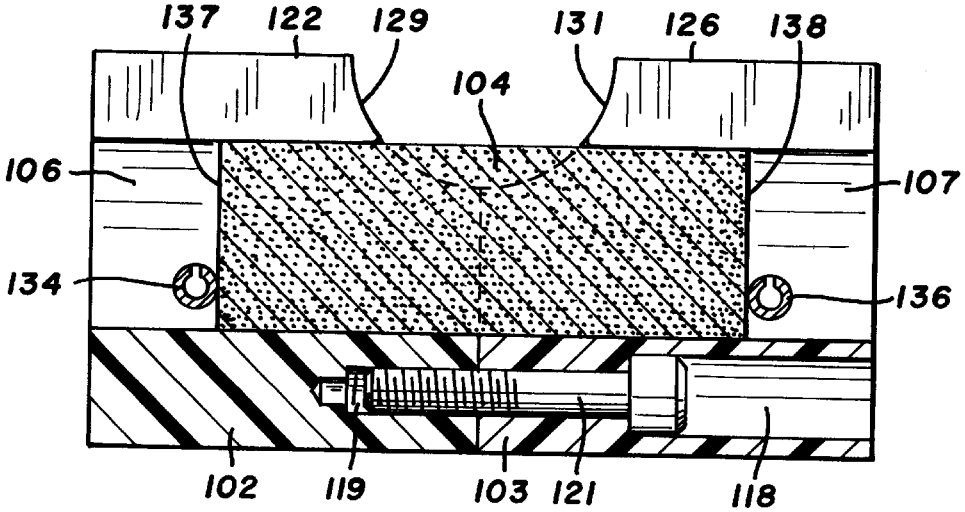
FIG. 26 is an enlarged sectional view taken along the line 26—26 of FIG. 23.
Figure 27:
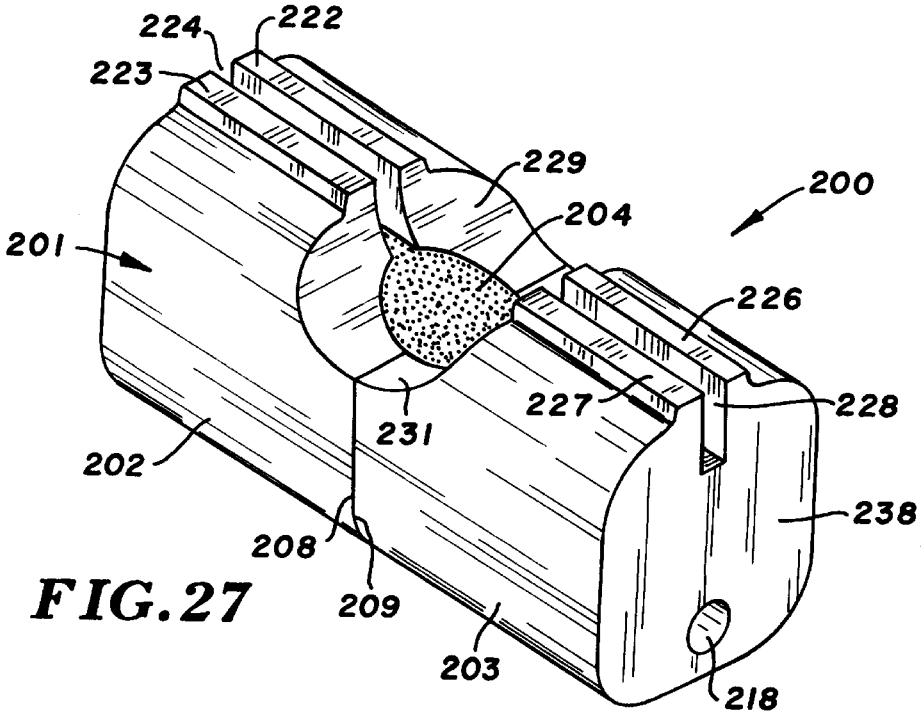
FIG. 27 is a perspective view of a second modification of the an ice skate blade sharpener of the invention.

Referring to FIG. 26, the bottom of member 103 has a counter sunk hole 118 aligned with a threaded bore 119 in member 102. A connector or bolt 121, located in hole 118, is threaded into hole 119 to hold members 102 and 103 in tight relationship relative to each other. Reference or aligning pins (not shown) can be used to facilitate alignment of body sections 102 and 103. Stone 104 is free to be rotated about its longitudinal axis, as indicated by arrow 139 in FIG. 23.

Returning to FIGS. 23–26, body member 102 has a pair of upright longitudinal flanges 122 and 123 laterally spaced from each other to form a longitudinal slot 124. The second body member 103 also has a pair of longitudinal flanges 126 and 127 laterally spaced from each other to form a slot 128. Slots 124 and 128 are in longitudinal alignment with each other and have a width substantially the same as the width of an ice skate blade. Slots 124 and 128 are open to and extend downwardly into bores 106 and 107 so that the edges of the skate blade do not contact body assembly 101 during the sharpening process. The adjacent inner top edges of body members 102 and 103 have concave recesses 129 and 131 forming a transverse space for accommodating a thumb or finger of the user used to rotate stone 104, as shown by arrow 139.

Referring to FIG. 26, stone 104 is an elongated one-piece cylindrical member of abrasive material having circular transverse flat ends 137 and 138. Ends 137 and 138 are located adjacent the transverse pins 134 and 136 to restrict longitudinal movement of stone 104, and yet allow the rotation of stone 104 relative to body members 102 and 103.

Figure 23:
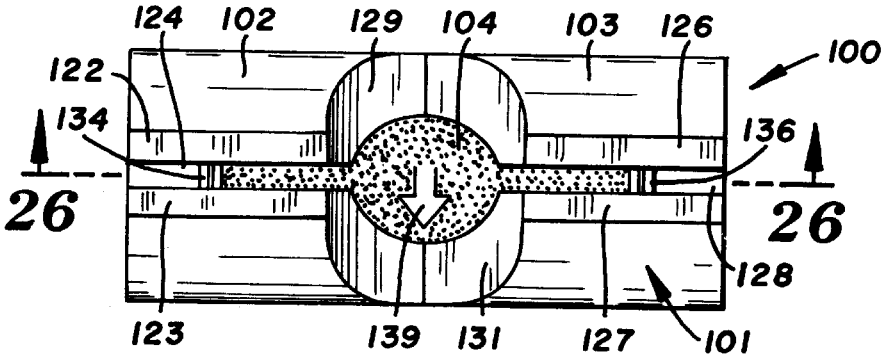
FIG. 23 is a top plan view of a first modification of the ice skate blade sharpener of the invention.
Figure 24:
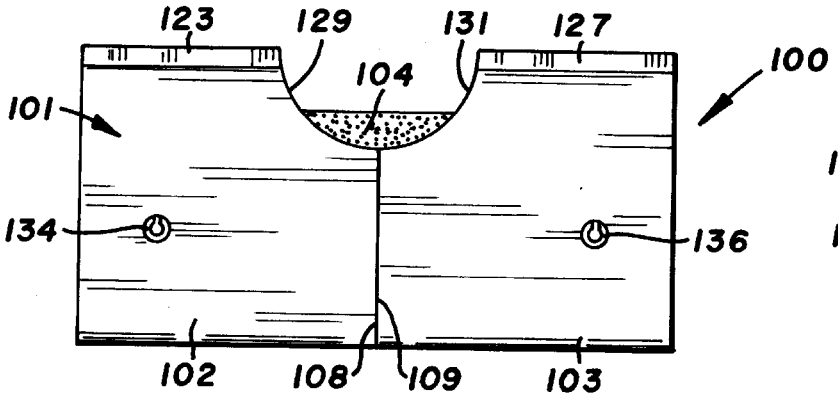
FIG. 24 is a side elevational view of the sharpener of FIG. 23.
Figure 25:
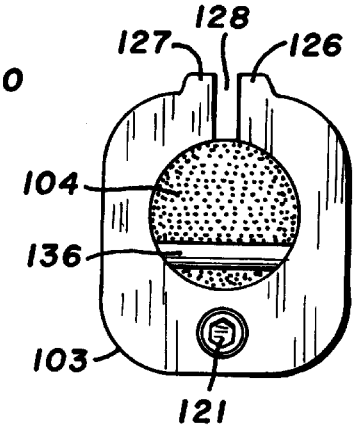
FIG. 25 is an enlarged end elevational view of the sharpener of FIG. 23.

Stone 104 has an outer cylindrical surface and diameter that is slightly less than the diameter of bores 106 and 107 to allow the stone to be rotated, as shown by arrow 139 in FIG. 23. The radius of curvatures of the outer surface of stone 104 is complementary to the concave curvature of the groove in the skate blade.

Stone 104 can be removed from body assembly 101 for replacement or cleaning purposes by removing bolt 121 and separating body members 102 and 103. Body members 102 and 103 can pull apart to permit stone 104 to be removed from bores 106 and 107. Body members 102 and 103 are then aligned and pushed together. Bolt 121, inserted into hole 118, is turned to secure body members 102 and 103 together. The sharpener 100 is used the same as sharpener 30 to sharpen the edges of a skate blade and maintain the longitudinal concave groove in the blade.

Referring to FIGS. 27–35, there is shown a second modification of the ice skate blade sharpener, indicated generally at 200, for resurfacing the bottom edge of an ice skate blade with a concave longitudinal groove in the bottom edge of the blade. Sharpener 200 has a body assembly indicated generally at 201 comprising two face-to-face body members or sections 202 and 203. Members 202 and 203 may be molded of rigid plastic, cast of metal or extruded metal, such as aluminum or composite of aluminum and ceramic, as disclosed in U.S. Pat. No. 5,395,701. An elongated cylindrical stone 204 of abrasive material is rotatably located in cylindrical bores 206 and 207 in members 202 and 203. Members 202 and 203 have adjacent flat transverse ends 208 and 209.

Figure 34:
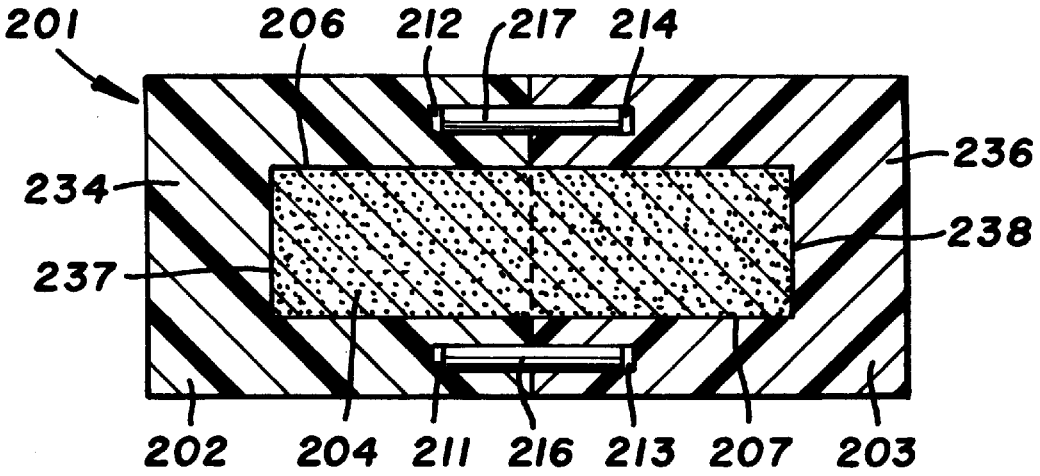
FIG. 34 is a sectional view taken along the line 34—34 of FIG. 29.
Figure 35:
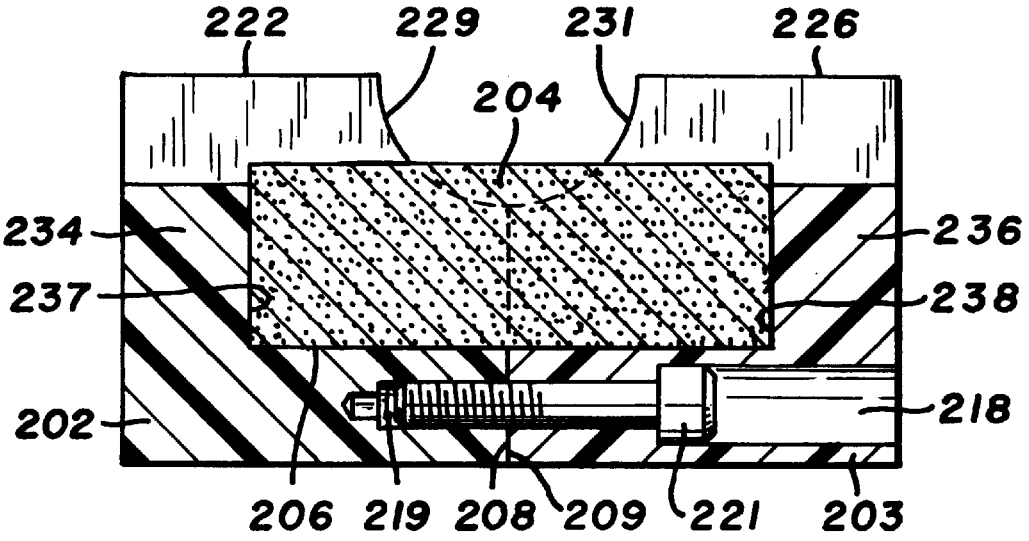
FIG. 35 is a sectional view taken along the line 35—35 of FIG. 28.

As shown in FIG. 34, member 202 has a pair of longitudinal blind holes 211 and 212 open to end 208. Holes 211 and 212 are aligned with holes 213 and 214 in member 203. A pair of pins 216 and 217 extend into holes 211, 213 and 212, 214 to maintain members 202 and 203 in longitudinal alignment with each other. Referring to FIG. 35, the bottom of member 203 has a counter sunk hole 218 aligned with a threaded bore 219 in member 202. A connector or bolt 221, located in hole 218, is threaded into hole 219 to hold members 202 and 203 in tight relationship relative to each other. Body member 202 has a closed end 234 closing the end of bore 206. Body member 203 also has a closed end 236 which longitudinally confines stone 204 in bores 206 and 207. Stone 204 is free to be rotated about its longitudinal axis, as indicated by arrow 239 in FIG. 28.

Returning to FIGS. 27–30, body member 202 has a pair of upright longitudinal flanges 222 and 223 laterally spaced from each other to form a longitudinal slot 224. The second body member 203 also has a pair of longitudinal flanges 226 and 227 laterally spaced from each other to form a slot 228. Slots 224 and 228 are in longitudinal alignment with each other and have a width substantially the same as the width of an ice skate blade. Slots 224 and 228 are open to and extend downwardly into bores 206 and 207 so that the edges of the skate blade do not contact end walls 234 and 236 during the sharpening process. The adjacent inner top edges of body members 202 and 203 have concave recesses 229 and 231 forming a transverse space for accommodating a thumb or finger of the user used to rotate stone 204, as shown by arrow 239.

Figure 31:
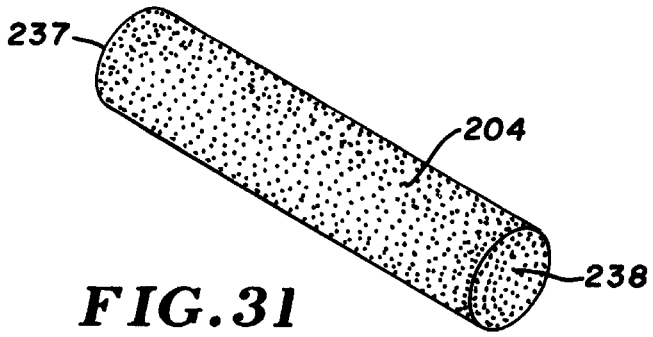
FIG. 31 is a perspective view of a cylindrical stone used with the sharpener of FIGS. 27–30.
Figure 32:
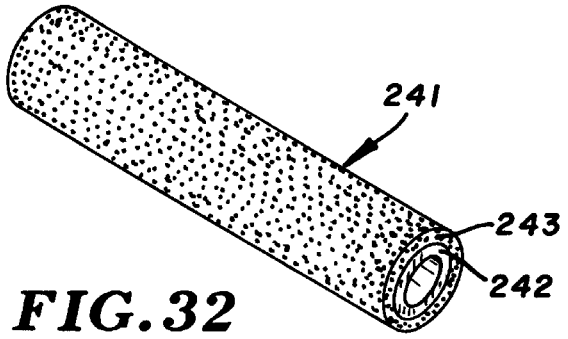
FIG. 32 is a perspective view of a modification of the cylindrical stone usable with the sharpener of FIGS. 27–30.
Figure 33:
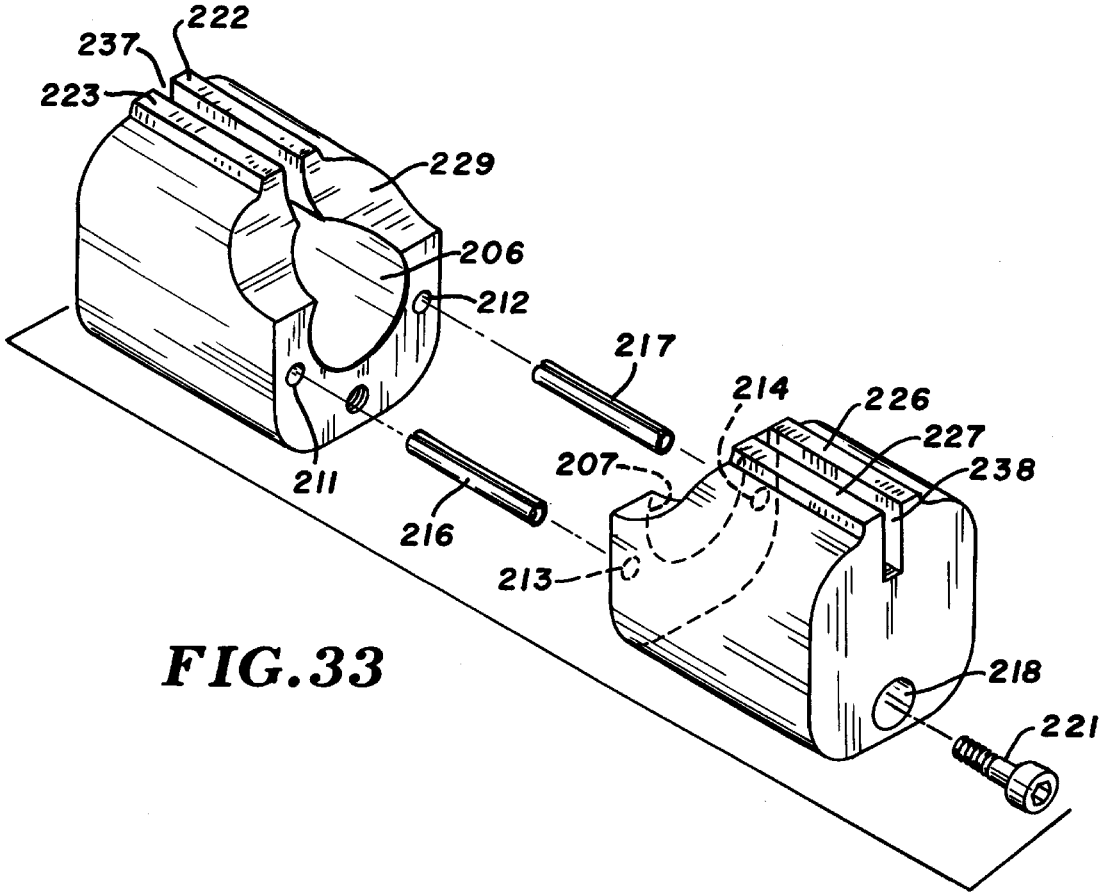
FIG. 33 is an exploded perspective view of the body assembly of the ice skate blade sharpener of FIGS. 27–30.

Referring to FIG. 31, stone 204 is an elongated one-piece cylindrical member of abrasive material having circular transverse flat ends 237 and 238. Ends 237 and 238 are located adjacent the inside surfaces of end walls 234 and 236 to restrict longitudinal movement of stone 204, and yet allow the rotation of stone 204 relative to body members 202 and 203.

Figure 28:
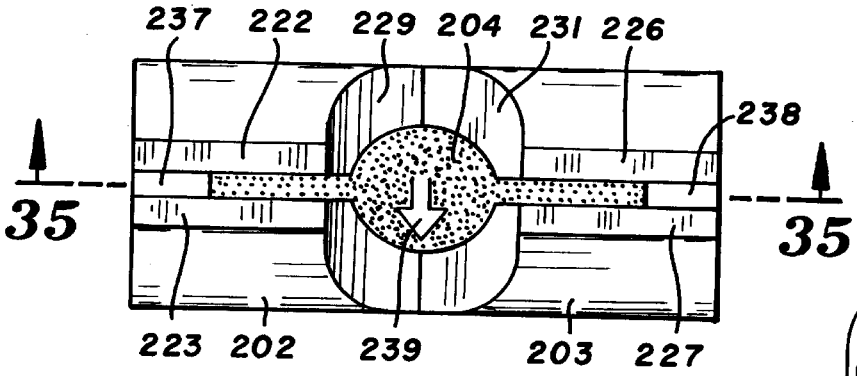
FIG. 28 is a top plan view of FIG. 27.
Figure 30:
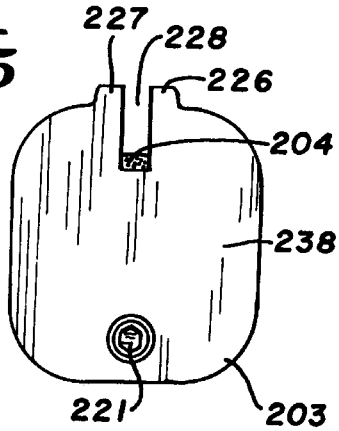
FIG. 30 is an end elevational view of FIG. 27.
Figure 29:
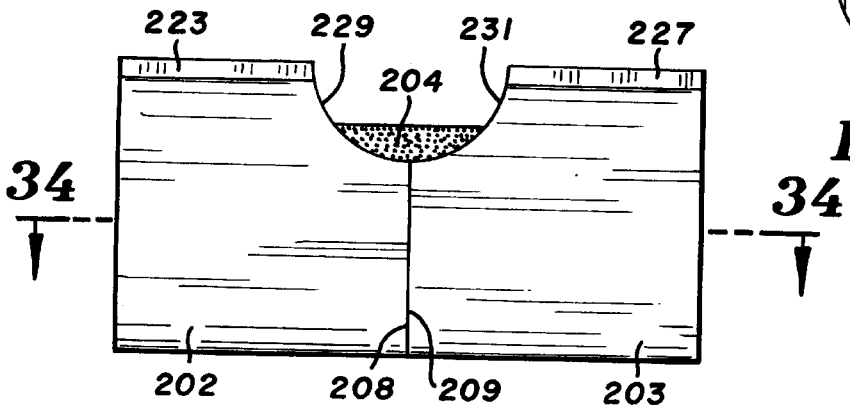
FIG. 29 is a side elevational view of FIG. 27.

Referring to FIG. 28, there is shown a modification of the stone, indicated generally at 241. Stone 241 has a sleeve or cylindrical core 242 that is coated with abrasive material 243. The abrasive material has a cylindrical outer surface and a diameter that fits into bores 206 and 207.

Stone 204 has an outer cylindrical surface and diameter that is slightly less than the diameter of bores 206 and 207 to allow the stone to be rotated, as shown by arrow 239 in FIG. 28. The radius of curvatures of the outer surface of stone 204 is complementary to the concave curvature of the groove in the skate blade.

Stone 204 can be removed from body 201 for replacement or cleaning purposes by removing bolt 221 and separating body members 202 and 203. Body members 202 and 203 can pull apart to permit stone 204 to be removed from bores 206 and 207. Body members 202 and 203 are then aligned with pins 216 and 217 and pushed together. Bolt 221, inserted into hole 218, is turned to secure body members 202 and 203 together. The sharpener 200 is used the same as sharpener 30 to sharpen the edges of a skate blade and maintain the longitudinal concave groove in the blade.

Referring to FIGS. 36–41, there is shown a third modification of the ice skate blade sharpener, indicated generally at 200, for resurfacing the bottom edge of an ice skate blade with a concave longitudinal groove in the bottom edge of the blade. Sharpener 300 has a body assembly indicated generally at 301 comprising two face-to-face body members or sections 302 and 303. Members 302 and 303 may be molded of rigid plastic, cast of metal or extruded metal, such as aluminum or composite of aluminum and ceramic. An elongated cylindrical stone 304 of abrasive material is rotatably located in cylindrical bores 306 and 307 in members 302 and 303. Members 302 and 303 have adjacent flat transverse ends 308 and 309.

Figure 40:
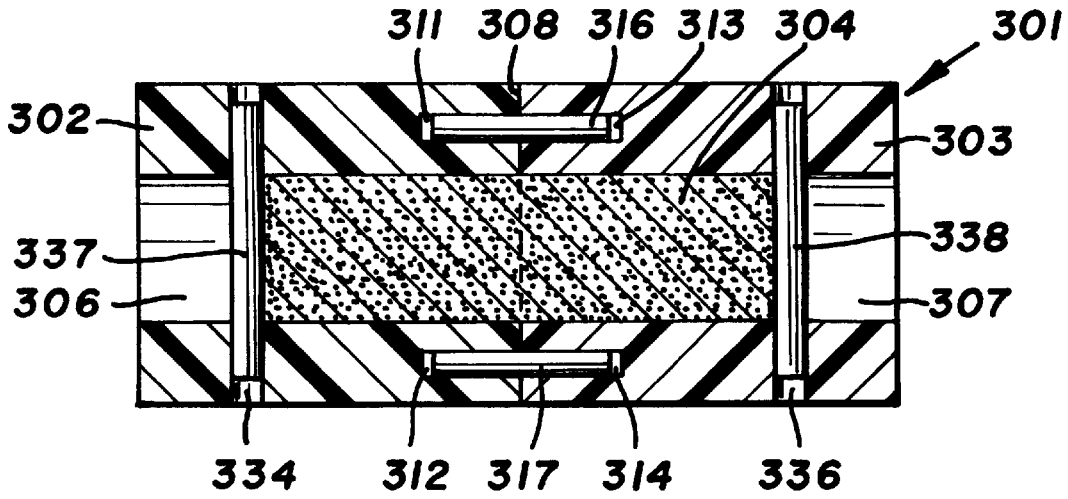
FIG. 40 is a sectional view taken along the line 40—40 of FIG. 38.
Figure 41:
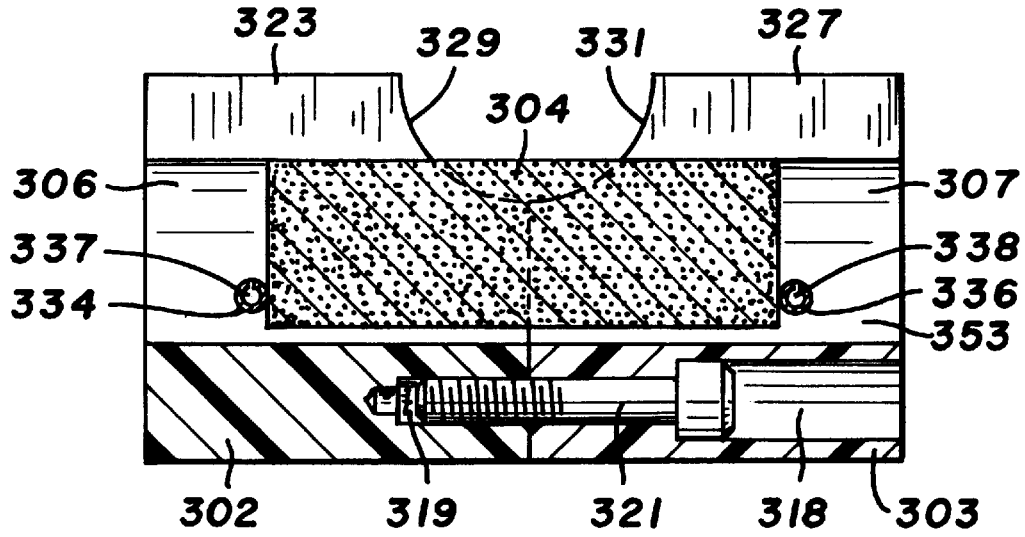
FIG. 41 is a sectional view taken along the line 41—41 of FIG. 37.

As shown in FIG. 40, member 302 has a pair of longitudinal blind holes 311 and 312 open to end 308. Holes 311 and 312 are aligned with holes 313 and 314 in member 303. A pair of pins 316 and 317 extend into holes 311, 313 and 312, 314 to maintain members 302 and 303 in longitudinal alignment with each other. Referring to FIG. 41, the bottom of member 303 has a counter sunk hole 318 aligned with a threaded bore 319 in member 302. A connector or bolt 321, located in hole 318, is threaded into hole 319 to hold members 302 and 303 in tight relationship relative to each other.

Returning to FIGS. 36–39, body member 302 has a pair of upright longitudinal flanges 322 and 323 laterally spaced from each other to form a longitudinal slot 324. The second body member 303 also has a pair of longitudinal flanges 326 and 327 laterally spaced from each other to form a slot 328. Slots 324 and 328 are in longitudinal alignment with each other and have a width substantially the same as the width of an ice skate blade. The adjacent inner top edges of body members 302 and 303 have concave recesses 329 and 331 forming a transverse space for accommodating a thumb or finger of the user used to rotate stone 304, as shown by arrow 339 in FIG. 37.

Figure 36:
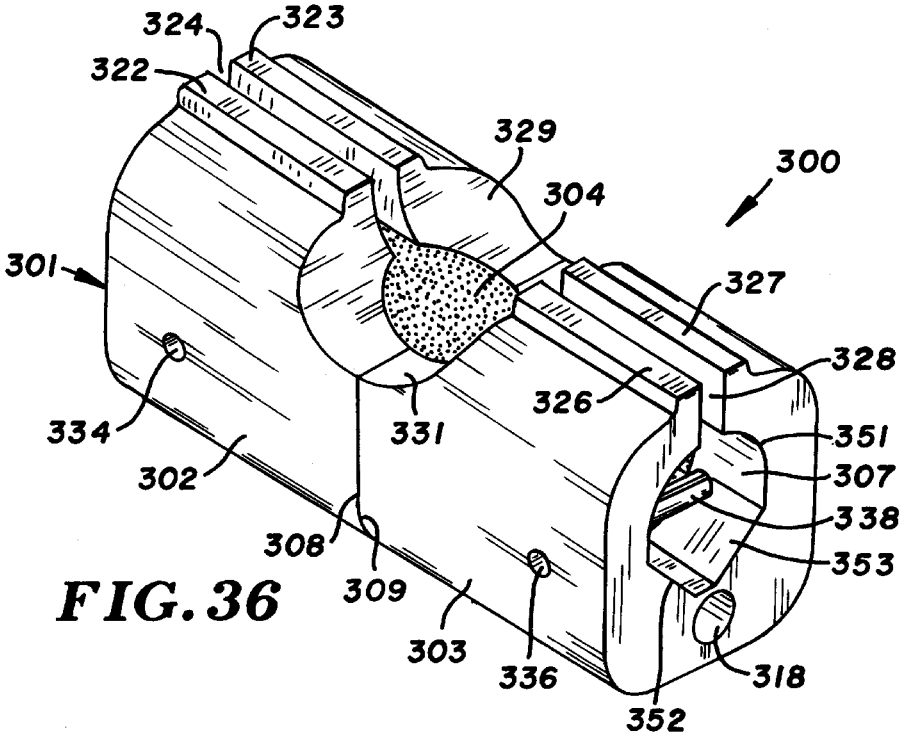
FIG. 36 is a perspective view of a third modification of the ice skate blade sharpener of the invention.
Figure 37:
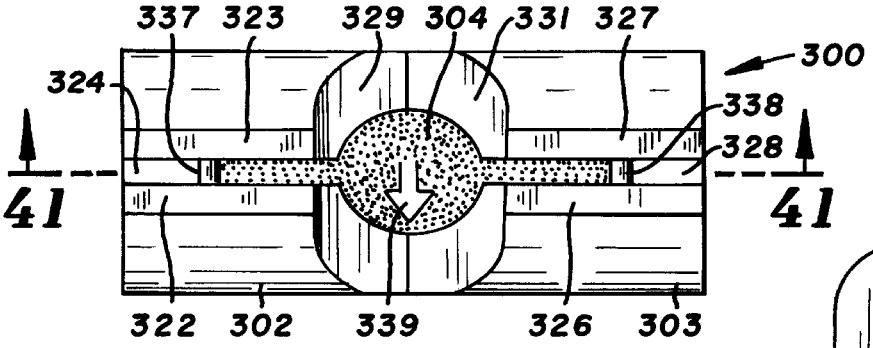
FIG. 37 is a top plan view of FIG. 36.

Body members 302 and 303 have transverse holes 332 and 333 accommodating split pins 334 and 336. Pins 334 and 336, as seen in FIG. 36, traverse longitudinal bores 306 and 307 that accommodate cylindrical stone 304 and are located adjacent opposite ends 337 and 338 of stone 304 to limit longitudinal movement of stone 304 in bores 306 and 307. As shown in FIG. 37, stone 304 can be rotated in the direction of arrow 339, since ends 337 and 338 merely ride against pins 334 and 336. Split pins 334 and 336 can be other transverse structures such as bolts threaded into the housing members 302 and 303.

Stone 304 is a cylindrical member of abrasive material having transverse flat ends 337 and 338. Abrasive material of stone 304 has an elongated cylindrical outer surface and a diameter that fits into cylindrical bores 306 and 307.

Figure 39:
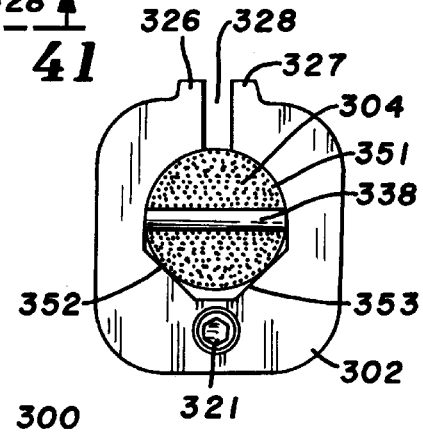
FIG. 39 is an end elevational view of FIG. 36.
Figure 38:
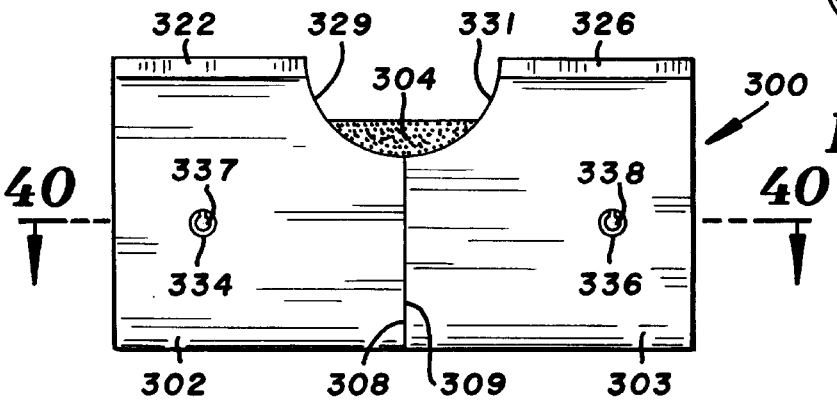
FIG. 38 is a side elevational view of FIG. 36.

Referring to FIGS. 36 and 39, body members 302 and 303 have a semi-circular top wall 351 that is intersected along its top with slots 324 and 328. Top wall 351 is joined at its opposite sides to downwardly and inwardly converging side walls 352 and 353 which form a V-shaped trough or groove. As seen in FIG. 39, the cylindrical stone 304 has opposite portions that rest on the V-shaped walls 352 and 353, thereby centering stone 304 in bores 306 and 307. V-shaped walls 352 and 353 maintain stone 304 in the centered or longitudinally aligned position relative to slots 324 and 328. Stone 304 can be manually rotated, as shown by arrow 339 in FIG. 37 with the thumb or finger of the user. The rotation of stone 304 does not change its centered or longitudinal position of stone 304 relative to slots 324 and 328.

Stone 304 can be removed from body assembly 301 for replacement or cleaning purposes by removing bolt 321 and separating body members 302 and 303. Body members 302 and 303 can pull apart to permit stone 304 to be removed from bores 306 and 307. Body members 302 and 303 are then aligned with pins 316 and 317 and pushed together. Bolt 321, inserted into hole 318, is turned to secure body members 302 and 303 together. The sharpener 300 is used the same as sharpener 300 to sharpen the edges of a skate blade and maintain the concave groove in the blade.

Referring to FIGS. 42–48, there is shown a fourth modification of the ice skate blade sharpener, indicated generally at 400, for resurfacing the bottom edge of an ice skate blade with a concave longitudinal groove in the bottom edge of the blade. Sharpener 400 has a body assembly indicated generally at 401 comprising two face-to-face body members or sections 402 and 403. Members 402 and 403 may be molded of rigid plastic, cast of metal or extruded metal, such as aluminum or a composite aluminum and ceramic. An elongated cylindrical stone 404 of abrasive material is rotatably located in blind bores 406 and 407 in members 402 and 403. Members 402 and 403 have adjacent flat transverse ends 408 and 409.

Figure 47:
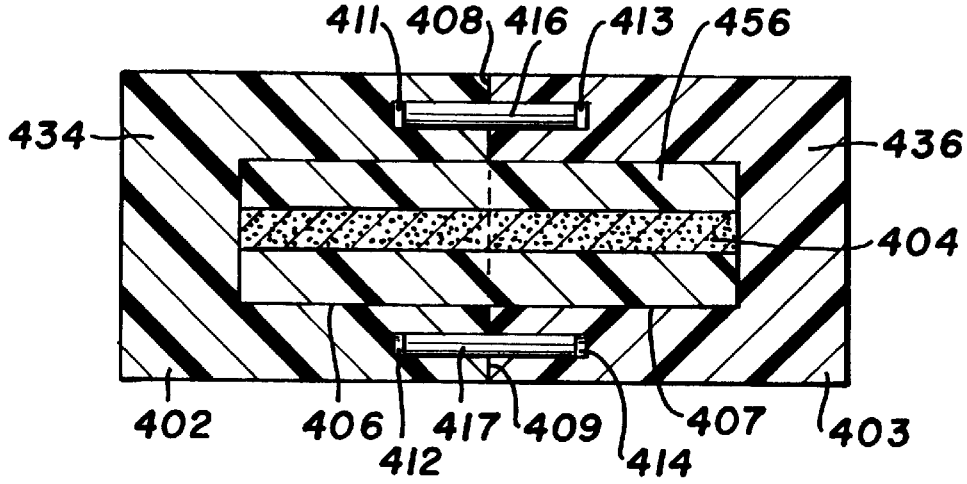
FIG. 47 is a sectional view taken along the line 47—47 of FIG. 43.
Figure 48:
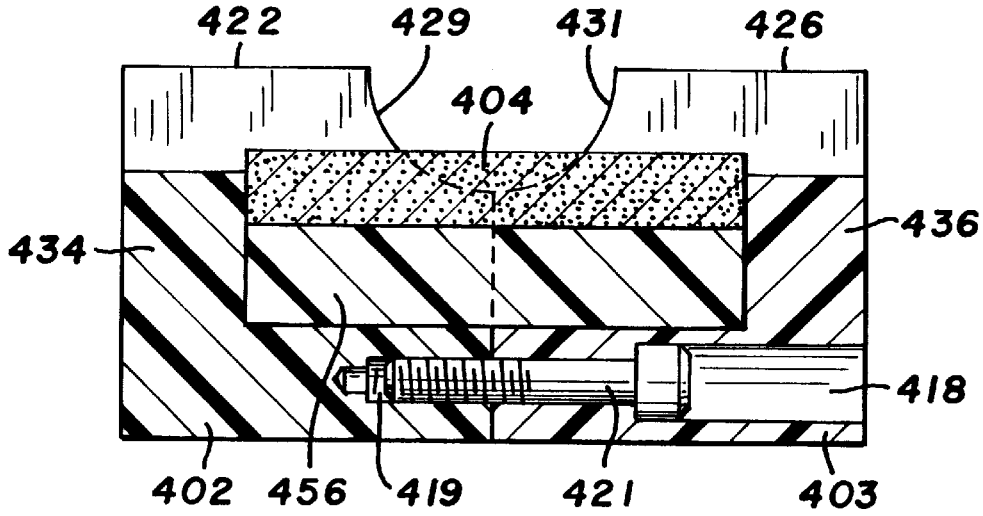
FIG. 48 is a sectional view taken along the line 48—48 of FIG. 43.

As shown in FIG. 47, member 402 has a pair of longitudinal blind holes 411 and 412 open to end 408. Holes 411 and 412 are aligned with holes 413 and 414 in member 403 open to end 409. A pair of pins 416 and 417 extend into holes 411, 413 and 412, 414 to maintain members 402 and 403 in longitudinal and transverse alignment with each other. Referring to FIG. 48, the bottom of member 403 has a counter sunk hole 418 aligned with a threaded bore 419 in member 402. A bolt 421, located in hole 418, is threaded into hole 419 to hold members 402 and 403 in tight relationship relative to each other. Bolt 421 is a releasable connector which can be removed so that the body members 402 and 403 can be pulled apart.

Returning to FIGS. 42–46, body member 402 has a pair of upright longitudinal flanges 422 and 423 laterally spaced from each other to form a longitudinal slot 424. Second body member 403 also has a pair of longitudinal flanges 426 and 427 laterally spaced from each other to form a longitudinal slot 428. Slots 424 and 428 are in longitudinal alignment with each other and have a width substantially the same as the width of an ice skate blade. Flanges 422, 423, 426, 427 and the upper portions of body members 402 and 403 have upright flat longitudinal surfaces forming the side walls of slots 424 and 428. The longitudinal surfaces function as guides for the blade of an ice skate that maintains the blade in alignment with the longitudinal diametrical axis of stone 404. The adjacent inner top edges of body members 402 and 403 have adjacent concave recesses 429 and 431 forming a transverse space for accommodating a thumb or finger of the user used to rotate stone 404.

As shown in FIGS. 42, 45, 47 and 48, body members 402 and 403 have ends 434 and 436 closing the outer ends of bores 406 and 407. Ends 434 and 436 retain stone 404 in bores 406 and 407 and allow stone 404 to be longitudinally rotated, as shown by arrow 437 in FIG. 43, to align selected parts of stone 404 with slots 424 and 428.

Figure 46:
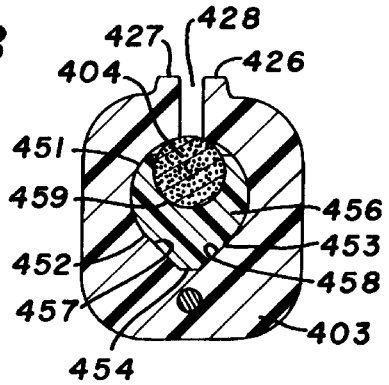
FIG. 46 is a sectional view taken along the line 46—46 of FIG. 43.
Figure 44:
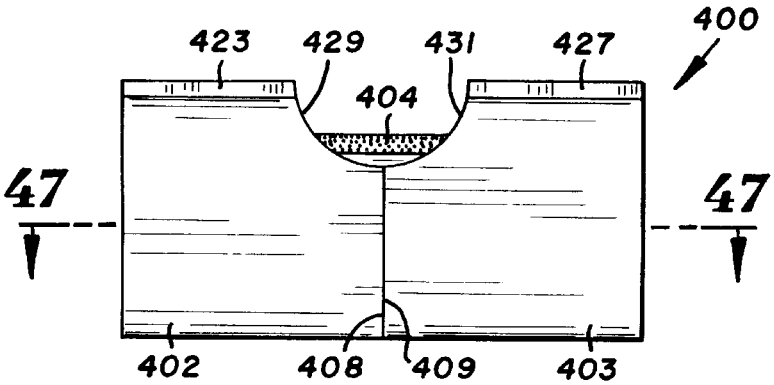
FIG. 44 is a side elevational view of FIG. 42.

Returning to FIG. 46, body 403 has an inside semicircular top wall 451 joined to downward and inwardly directed side walls 452 and 453. Walls 452 and 453 are joined at a concave apex 454 vertically aligned with slot 428. A stone holder 456 has outer surfaces that are complementary to surfaces 451, 452 and 453 of body members 402 and 403. Holder 456 has downward and inward side walls 457 and 458 that engage walls 452 and 453 to transversely locate holder 456 in bores 406 and 407. The opposite ends of holder 456 are adjacent ends 434 and 436 of body members 402 and 403 to restrict longitudinal movement of holder 456 in bores 406 and 407. As shown in FIG. 46, the upper portion of holder 456 has a curved longitudinal recess 459 accommodating cylindrical stone 404. Stone 404 is rotatable relative to holder 456. The user, with the thumb or finger, applies a transverse force on stone 404 to rotate stone 404. The size or diameter of recess 459 can be changed to accommodate different sized stones. Different sized holders and stone are used to alter the concave arc of the groove in the skate blade.

While there has been shown and described preferred embodiments of the ice skate blade sharpener according to the present invention, it is understood that changes in structure, materials and design can be made by persons skilled in the art without departing from the substance of the invention. The invention is defined in the following claims.

I claim:

1. A device for sharpening the blade of an ice skate comprising: body means having a first section and a second section, each section having an end wall and a transverse wall, a longitudinal chamber extending between the end walls, and a longitudinal slot extended normal to the transverse wall of each section and open to the chamber and each end wall for accommodating the blade, an abrasive means located within the chamber having a surface for sharpening the blade of an ice skate, holder means located in the chamber rotatably supporting the abrasive means, the holder means and abrasive means having ends engaging the end walls of the body means to fix the longitudinal position of the holder means and abrasive means thereby limiting longitudinal movement of the holder means and abrasive means relative to the body means, means associated with the holder means for retaining the holder means in a fixed circumferential position within the chamber and preventing rotational movement of the holder means relative to the body means, and a groove extended into at least one wall of the body means whereby the abrasive means can be manually rotated relative to the holder means to position a selected portion of the abrasive means adjacent the slot, means releasably connecting the first section to the second section to hold the transverse walls of the first and second sections together and allow the first and second sections to be separated so that the holder means and abrasive means can be removed from the chamber and replaced with another holder means and abrasive means having the same or a different sized abrasive means.

2. The device of claim 1 wherein: the groove has a bottom portion intersecting a top portion of the chamber whereby the abrasive means can be manually rotated relative to the holding means.

3. The device of claim 1 wherein: the abrasive means is a generally cylindrical stone rotatably supported by the holding means.

4. The device of claim 1 including: flange means on the body means on opposite sides of the slot, said flange means comprises transversely spaced flanges, each flange having an inner surface vertically aligned with an outer side of the slot.

5. The device of claim 4 including: means removably mounted on the flange means to selectively adjust the width of the slot.

6. The device of claim 1 wherein: the body means has generally flat converging inside walls opposite the slot, said means associated with said holder means including generally flat converging walls on the holder means engageable with the inside walls of the body means to prevent rotational movement of the holder means relative to the body means.

7. The device of claim 6 wherein: the holder means has a generally semi-cylindrical groove, said abrasive means comprising a cylindrical member of abrasive material located in said groove.

8. The device of claim 1 including: hole means in one section of the body means and pin means in the other section of the body means, said pin means being located in the hole means to align the first and second sections of the body means.

9. The device of claim 8 wherein: said hole means comprises a pair of longitudinal holes on opposite sides of the chamber, and said pin means comprises a pair of longitudinal pins located in said holes to retain said first and second sections in alignment with each other.

10. The device of claim 8 wherein: the means releasably connecting the first section to the second section includes a member extended between said sections and engageable with the first section and second section, said member being removable from said first and second sections whereby said first and second sections can be separated and the holder means and abrasive means can be removed from the chamber and replaced with another holder means and abrasive means.

11. The device of claim 1 wherein: the means releasably connecting the first section to the second section including at least one bolt connecting the first and second sections together.

12. A device for sharpening a longitudinal blade comprising: a housing having a first section and a second section, said first and second sections having engaging transverse ends, fastening means releasably coupling the first and second sections to hold the transverse ends in engagement with each other, the housing having an inner chamber extended into the first and second sections, said first and second sections having inner surfaces at opposite ends of the chamber, and a longitudinal slot open to the chamber for accommodating the blade, first means located in the chamber engageable with the blade for sharpening the blade, said first means having a member and abrasive means rotatably mounted on the member with the blade located in the slot to sharpen the blade, the member and abrasive means having ends engaging inner surfaces of the first and second sections to fix the longitudinal position of the first means and prevent longitudinal movement of the first means relative to the housing, second means associated with the member to fix the circumferential position of the member and prevent rotational movement of the member relative to the housing, and a groove extended into the housing whereby the abrasive means can be manually rotated relative to the member to position a selected portion of the abrasive means adjacent the slot.

13. The device of claim 12 wherein: each section of the housing has generally flat converging inside walls, said second means comprising generally flat converging walls on the member engageable with the inside walls to prevent rotation of the member relative to the housing.

14. The device of claim 13 wherein: the member has a generally semi-cylindrical groove, said abrasive means comprising a cylindrical member of abrasive material located in said groove whereby the cylindrical member of abrasive material can be rotated to said member having the cylindrical groove.

15. The device of claim 12 wherein: the engaging transverse ends having longitudinally aligned holes, the means releasably coupling the first and second sections including pin means located in holes in each section, and connector means holding the sections together.

16. The device of claim 12 wherein: the abrasive means is a generally cylindrical stone of abrasive material rotatably supported by the member.

17. A device for sharpening the blade of an ice skate comprising: body means having generally flat converging lower inside walls and a semi-cylindrical upper inside wall joined to the lower inside walls to provide a longitudinal chamber, said body means including laterally spaced longitudinal surfaces extended to the upper inside wall forming a slot open to the chamber to accommodate a blade of an ice skate, a cylindrical abrasive member located in said chamber engageable with longitudinal portions of the converging lower inside walls of the body means to center the abrasive member in said chamber and locate a longitudinal section of the abrasive member aligned with the slot, and means associated with the body means to retain the abrasive member in said chamber, and a groove in said body means open to the chamber whereby the abrasive member can be rotated relative to the body means.

18. The device of claim 17 wherein: the laterally spaced longitudinal surfaces forming a slot are joined to the upper inside wall of the body means, said lower inside walls joined at a concave apex located in a vertical plane that includes the slot.

19. The device of claim 17 wherein: the means associated with the body means includes means adjacent opposite ends of the abrasive member to limit longitudinal movement of the abrasive member relative to the body means.

20. The device of claim 19 wherein: the means adjacent opposite ends of the abrasive means includes retainers removably mounted on the body means.

21. The device of claim 17 wherein: the body means has a first section and a second section, said sections having adjacent transverse walls, and means releasably connecting the first and second sections together with the adjacent transverse walls in engagement with each other.

22. The device of claim 21 wherein: the adjacent walls have longitudinally aligned holes, and pin means located in said holes.

23. The device of claim 22 wherein: the means releasably connecting the first and second sections together includes a connector member extended between said sections and engageable with said sections, said connector member being removable from said first and second sections whereby said first and second sections can be separated and the abrasive member can be removed from the chamber and replaced with another abrasive member.

24. A device for sharpening a blade of an ice skate comprising: a body having a first section and a second section, each section having an inside wall surrounding a chamber, a first end wall closing one end of the chamber, a second transverse end wall open to the chamber, and laterally spaced walls forming a slot open to the chamber for accommodating a blade of an ice skate, a cylindrical abrasive member located in the chamber of each section, connector means holding the second end walls of the sections together and retaining the abrasive member in the chambers, said abrasive member having opposite ends adjacent the first and second end walls to inhibit longitudinal movement of the abrasive member relative to the body and permit rotational movement of the abrasive member relative to the body and at least one of said sections having means to allow manual rotation of the abrasive member relative to the body.

25. The device of claim 24 wherein: second wall of each section has at least one longitudinal hole, and pin means located in the hole of each section to align the first and second sections of the body.

26. The device of claim 24 wherein: the connector means includes a connector member extended between said sections and engageable with said sections, said connector member being removable from said sections whereby said sections can be separated and the abrasive members can be removed and replaced with another abrasive member.

27. The device of claim 26 wherein: the connector member includes at least one bolt connecting the sections together.

28. An apparatus for sharpening a blade of an ice skate comprising:

a cylindrical abrasive element, a holder for the abrasive element, said holder having a cavity formed therein to receive the abrasive element and allow the abrasive element to be rotated relative to the holder, and an arcuate outer surface having a radius of curvature different from the arcuate surface of the abrasive element, said abrasive element being located in said cavity, a housing having a chamber formed therein, said chamber shaped and sized to receive the holder and abrasive element, said holder and abrasive element being located in said chamber, said housing having an elongated slot communicating with said chamber and sized to permit a blade of an ice skate to pass therethrough, and means for orienting the holder located in the chamber with a portion of the abrasive element addressing the slot.

29. The apparatus of claim 28 wherein:

the holder has a longitudinal axis and is generally cylindrical, and the chamber formed within the housing is cylindrical and sized to receive said holder and abrasive element located in the cavity of the holder.

30. The apparatus of claim 28 wherein:

the cavity in the holder is cylindrical, said cavity having a longitudinal axis offset with respect to the longitudinal axis of the holder, and the abrasive element is sized and shaped to fit into the cavity to permit the abrasive element to be rotated relative to the holder.

31. The apparatus of claim 28 wherein:

the housing is bifurcated into first and second housing sections along a plane generally perpendicular to the longitudinal axis of the housing, means for registering the first housing section in longitudinal alignment with the second housing section, and means for maintaining the first and second housing sections in mated configuration.

32. The apparatus of claim 28 wherein:

the housing has an opening intersecting a portion of the chamber whereby the abrasive element can be manually rotated within the chamber to position a selected longitudinal section of said abrasive element adjacent the slot.

* * * * *